United States Patent [19]

Brown

[11] 3,946,693

[45] Mar. 30, 1976

[54] REMOVABLE INBOARD RUDDER

[76] Inventor: Marshall S. B. Brown, 1041 Avon Blvd., Cheshire, Conn. 06410

[22] Filed: Mar. 3, 1975

[21] Appl. No.: 555,076

Related U.S. Application Data

[63] Continuation of Ser. No. 420,383, Nov. 30, 1973, abandoned.

[52] U.S. Cl. ..... 114/165; 114/128; 114/162

[51] Int. Cl.[2] ..... B63H 25/06

[58] Field of Search ..... 114/127, 128, 130, 131, 114/132, 133, 138, 139, 162, 164, 165, 167

[56] References Cited

UNITED STATES PATENTS 75,964 3/1868 Pember ..... 114/165

1,206,368 11/1916 Piazze ..... 114/165

*Primary Examiner*—Trygve M. Blix

*Assistant Examiner*—Charles E. Frankfort

[57] ABSTRACT

An inboard rudder capable of being removed and mounted through a hollow trunk within the hull of the boat and so arranged that the rudder post is pivotally mounted and held in place against one side of the trunk by means of a filler member which is inserted into the trunk after the rudder has been lowered into position.

6 Claims, 8 Drawing Figures

REMOVABLE INBOARD RUDDER

This application is a continuation of my copending application, Ser. No. 420,383 filed Nov. 30, 1973 and now abandoned.

BACKGROUND OF THE INVENTION

The present invention relates to steering devices for boats, and it relates more particularly to inboard rudders which are mounted so that they can be readily removed when the boat is in shallow water or beached.

Many small craft, especially sailboats are provided with rudders which are easily removable so that they can be lifted out of the water when the boat is in shallow water. However, such removable rudders are usually mounted outboard of the hull on the stern post or transom of the boat. Inboard rudders, that is, those in which the rudder post extends through the bottom of the boat instead of being mounted outside it are generally permanently mounted in the hull. In sailboats with fixed keels, a permanent rudder is no problem, because the keel determines the draft of the boat, and the rudder is almost never deeper than the keel.

But in boats with no keel or with centerboards or daggerboards, which can be raised into the boat, outboard rudders have been used so that the rudder can also be raised or removed. From a marine-design standpoint the disadvantage of an outboard rudder is that the boat steers on its own length as a turning radius instead of within its own length as in the case of a boat with an inboard rudder. Consequently, a boat having an inboard rudder has a shorter turning radius than one the same length having an outboard rudder. Inboard rudders, therefore, provide better maneuverability than outboard rudders. This, of course, is important for racing purposes especially.

It is an object of the present invention to provide a boat with an inboard rudder which can be raised, removed and replaced as readily as one that is mounted outboard.

SUMMARY OF THE INVENTION

Basically, the invention resides in providing a hollow trunk through the hull of the boat, that is open at the bottom of the boat, as well as at its upper end, so that the rudder assembly can be lowered, rudder first, through the trunk until the rudder is below the hull with the rudder post extending upward through and adjacent one side of the trunk where it is held in place by a removable filler member shaped to fill the remaining space within the trunk. A seat for the rudder post is formed in one side of the trunk for partially supporting the rudder post with the filler member holding the post against this seat. The opening at the bottom of the trunk must of course be large enough to allow the rudder to pass completely through it. However, in order to prevent the rudder assembly from dropping completely through, the rudder post is provided with some means for locating it vertically. Such means may be, for example, a collar or flange at the upper end of the post which is larger across than the opening in the trunk.

The filler member is likewise provided with means for preventing it from dropping through the opening in the trunk. The best way to do this is to make the opening at the bottom of the trunk smaller than at the top so that the endwalls of the trunk converge toward the bottom. The filler member, or in this instance wedge member, is similarly shaped so that its wide end does not fit through the slot in the hollow trunk. An advantage of using a wedge member of this kind is that the wedge forces the rudder post against the seat in the trunk, thereby positively holding the rudder post in place.

However, if the space within the trunk is uniform in length as well as in thickness, the filler member must of course be provided with some kind of stop, such as a plate on its upper edge which is wider than the thickness of the slot in the trunk in order to prevent the filler member from dropping through.

In a particularly desirable embodiment of the invention, one-half of the bearing in which the rudder pivots is formed directly in the seat portion of the trunk and the other half in a wedge member. For example, the seat for the rudder post may comprise a semi-cylindrical groove extending from the top to the bottom of the trunk and having a radius corresponding to that of the rudder post. The wedge member is likewise provided with a semi-cylindrical groove of the same radius along the surface which engages the other side of the rudder post, holding it in place and thereby providing bearing surfaces within which the post can freely turn.

DETAILED DESCRIPTION OF PREFERRED EMBODIMENT

A particularly desirable design for a removable inboard rudder embodying the invention is illustrated in the accompanying drawings, wherein FIG. 1 is a view in vertical section along the centerline of the stern portion of a boat showing the rudder in place, the portion of the boat from the after part of the cockpit forward being omitted;

Figure 2:
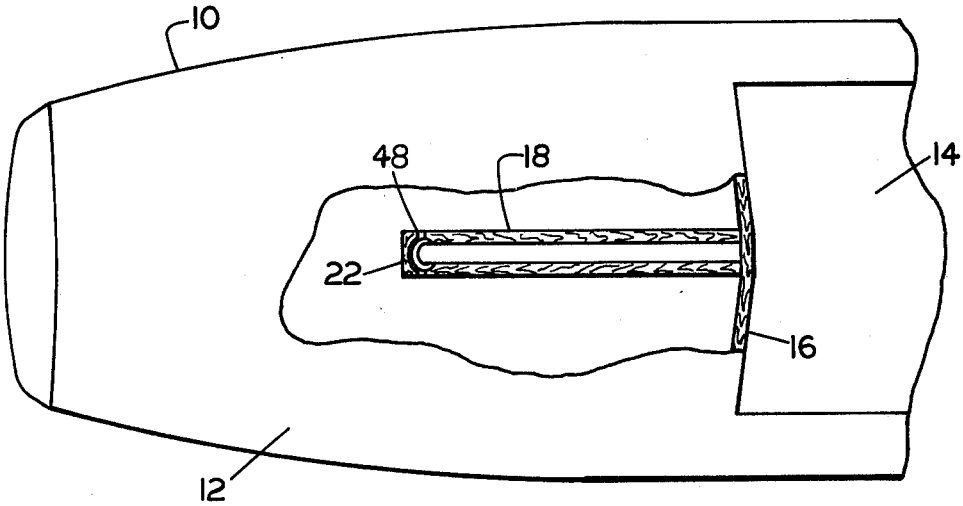
FIG. 2 is a plan view of the same portion of the boat with part of the after deck broken away with the rudder and filler member removed.
Figure 6:
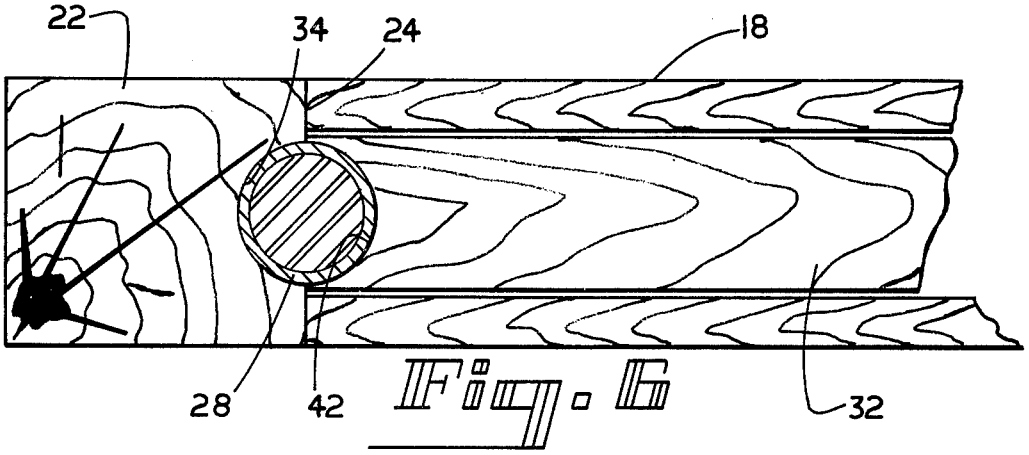
FIG. 6 is an enlarged cross-sectional view through the trunk, rudder post and wedge member, taken on the line 6—6 of FIG. 1, with the front portion of the trunk and wedge member broken away.
Figure 7:
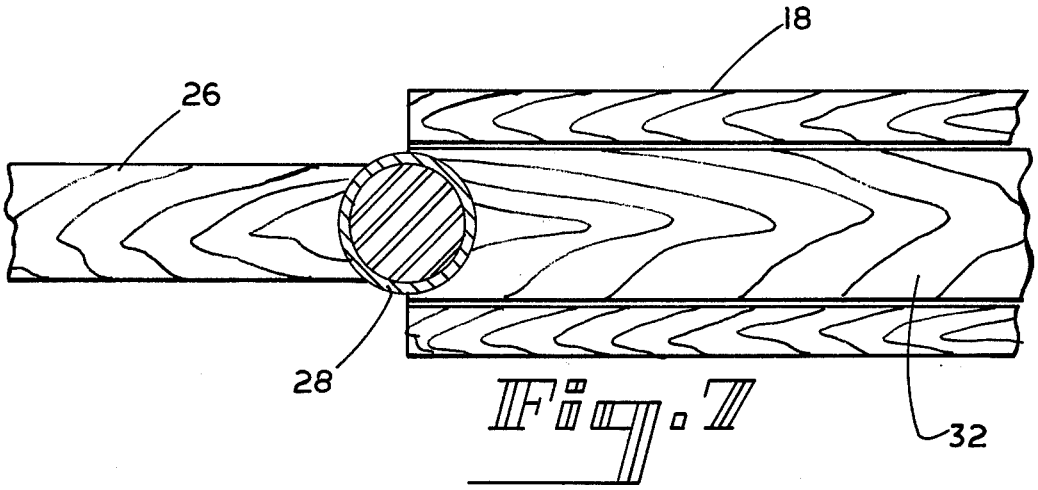
Figure 8:
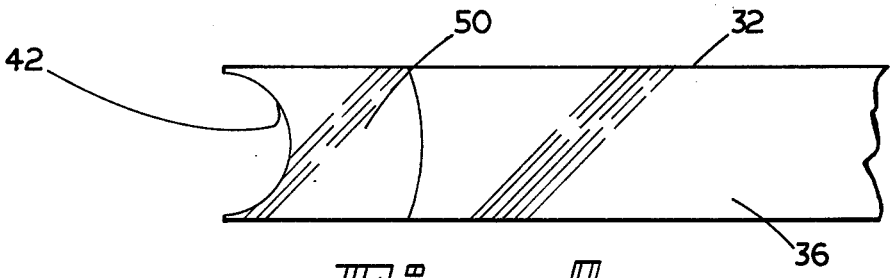

FIG.. 7 is a view similar to FIG. 6 but taken on the line 7—7 of FIG. 2 and showing a portion of the rudder; and FIG. 8 is an enlarged detail view of the upper rear edge of the wedge member, the front portion of which is broken away.

Figure 1:
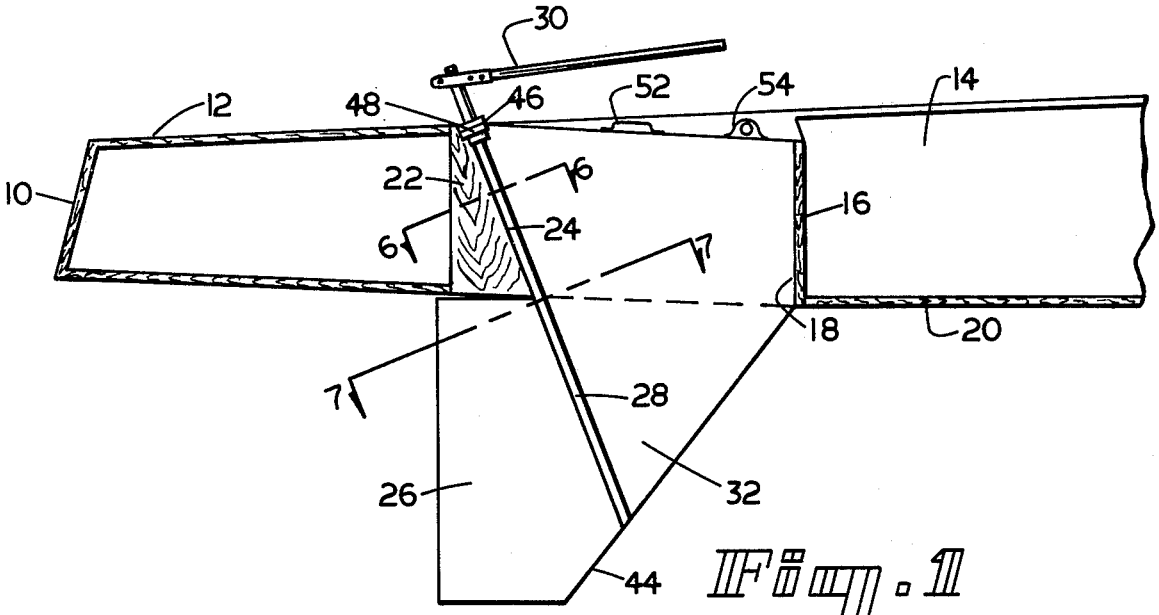

As illustrated in FIGS. 1 and 2, the reference numeral 10 designates the hull of the boat, desirably a small, planing type sailboat, designed for shallow water sailing and beaching. In this instance the boat is provided with an after deck 12 which extends forward from the transom to, and on both sides of, a cockpit 14. Extending rearward along the centerline of the boat from the after bulkhead 16 of the cockpit is a rudder trunk or hollow housing 18 which forms a narrow slot that is open both upward through deck 12 and downward through the keel 20 at the bottom of the boat, like the trunk for a centerboard or daggerboard. Trunk 18 consists of spaced parallel side panels joined at one end by the bulkhead 16 which is substantially vertical and at the other end by a strut 22. As viewed in elevation (FIG.

1), strut 22 is shaped like a right triangle with the hypotenuse forming the rear end-wall 24 of the slot in trunk 18, and with its rear side disposed substantially perpendicular to keel 20 and parallel to bulkhead 16. The vertical slot through trunk 18 accordingly forms a trapezoid, as viewed in elevation, with the shorter of its two parallel sides located at the bottom where it passes through the keel 20.

Figure 3:
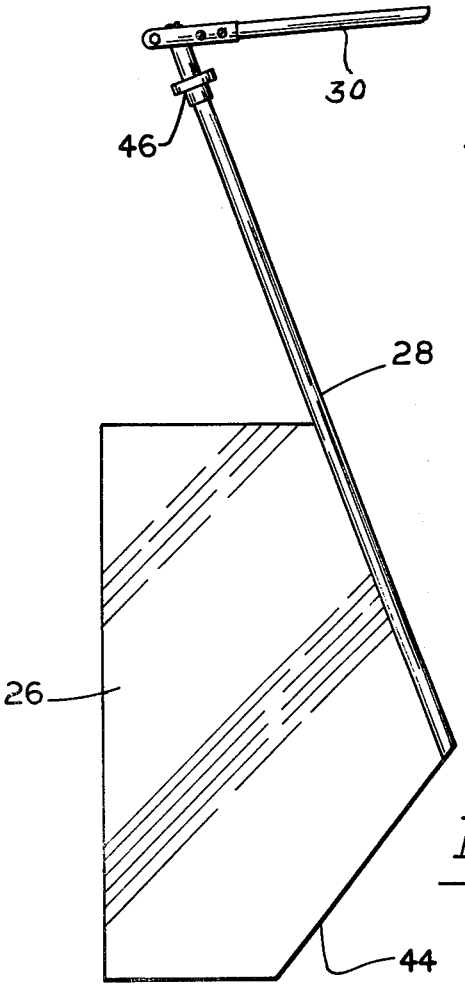
FIG. 3 is a side elevational view on a larger scale of the rudder assembly.

A rudder assembly, shown on a larger scale in FIG. 3, consists of the rudder 26 rigidly fastened along one of its forward edges to the lower end of a tubular rudder post 28. A conventional tiller 30 is connected in any suitable manner to the upper end of rudder post 28 by which to manipulate the rudder and is desirably hinged so that its free end can swing up and down in order to provide the helmsman with greater freedom to move about. Rudder post 28 is held by a filler or wedge member 32 against the inclined edge 24 of strut 22 with the rudder 26 projecting below the bottom of the boat. In this instance wedge member 32 is inserted into the slot in front of the rudder post so that it completely fills the space within trunk 18 and forces post 28 against a semi-cylindrical groove 34 (FIG. 6) in the edge 24 of strut 22, forming the seat for the rudder post. The narrower portion of the bottom of the slot in trunk 18 must be longer than the greatest dimension of rudder 26 so that the rudder can pass completely through. For the same reason, the width of the slot in trunk 18 must also be wider than the thickest part of rudder 26 or its post 28.

Figure 4:
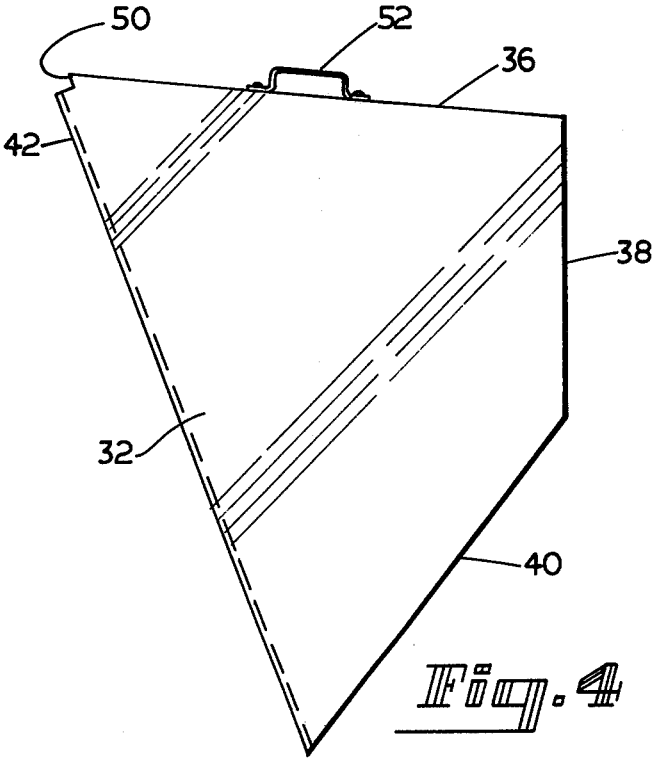
FIG. 4 is a side elevational view of the filler or wedge member shown on the same scale as FIG. 3.

As shown in FIG. 4, wedge member 32 has upper, front, bottom and rear edges 36, 38, 40 and 42, respectively, which form a trapezium corresponding with the trapezoidal slot within the rudder trunk 18. Thus, when wedge member 32 is fully inserted within trunk 18, its upper edge 36 is disposed flush with the deck 12 of the boat while the front edge 38, which is disposed substantially perpendicular to the top edge 36, rests flush against the back of the bulkhead 16 and terminates at the bottom of the boat. The bottom edge 40 of wedge member 32 desirably rakes rearwardly below keel 20 to the base of rudder post 28 and is co-extensive with the lower, front edge 44 of rudder 26, which is desirably shaped to extend below the lower end of the post 28. The rear edge 42 of wedge member 32 extends upward along rudder post 28 to the top of the trunk 18 and is semi-cylindrically grooved, as shown in FIG. 8, so that it embraces the front side of the rudder post, completing the cylindrical bearing therefor. Since the radius of both the seat 34 in trunk 18 and the rear edge 42 of the wedge matches that of the rudder post, rudder post 28 is held firmly in place between the seat 34 on trunk 18 and bearing surface 42 on the wedge member 32 so that it can pivot freely about its longitudinal axis.

In order to position the rudder post 28 lengthwise so that it cannot drop below the position shown in FIG. 1, a collar 46 of suitable material, such as oillite bronze or nylon, is fixed near the upper end of the post 28, thereby providing a bearing surface on its underside for engagement with a mating Teflon bushing 48 mounted in the upper edge of the trunk 18 or in the deck 12. Bushing 48 is horseshoe shaped in order to receive the rudder post as it is inserted laterally into position against the bearing surface or seat 34. The upper rear corner of wedge member 32 should be notched at 50, as shown in FIGS. 4 and 8, so that as it is inserted into position within trunk 18, it can clear the collar 46 on the rudder post. The upper edge 36 of the wedge member is also provided with a handle 52, by which the wedge is lifted out of trunk 18, when it is desired to raise the rudder.

Figure 5:
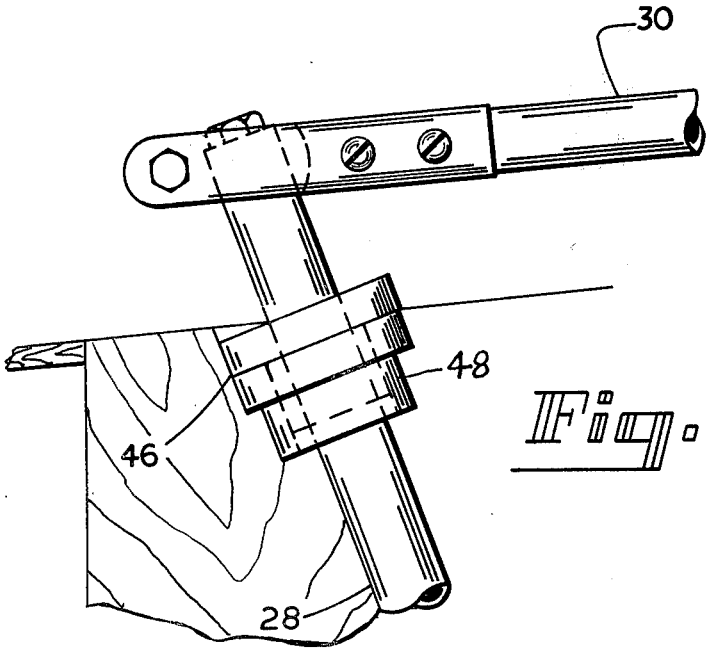
FIG. 5 is a still further enlarged detail view of the upper end of the rudder post and part of the tiller, as well as a portion of the boat.

It will be readily apparent from the foregoing description that in order to mount the rudder, the rudder assembly is inserted into the slot in trunk 18 and pushed down and then to the rear until the collar 46 engages the deck 12 and slides into position with the bushing 48 at the rear end of trunk 18 as shown in FIGS. 1 and 5. The wedge member 32 is then inserted into the trunk until its upper edge 36 is flush with deck 12, thereby completely filling the balance of the space within trunk 18 and holding rudder post 28 in its proper position between the bearing surfaces 34 and 42. If there is any tendency for the rudder to float upward within trunk 18 before the wedge 32 is lowered into place, the upper end of the rudder post is simply held down against the rear end of the slot in the trunk with the collar 46 engaging the bushing 48 and the wedge pressed down into the trunk so that its rear edge 42 comes in contact with the lower end of the rudder post and moves it into seating engagement with the seat 34 in the trunk. While the wedging action and weight of the wedge member against the rudder post should be sufficient to keep the rudder in place at all times, it may be desirable for safety sake to provide a suitable fastener 54 for locking the top edge of the wedge in position at deck level. Such a fastener may consist of a sliding or pivoted plate or bolt, for example.

The design of the rudder 26 illustrated is one that generally is used in connection with a skeg, which is a sloping part of the hull that projects downward from the keel and blends with the lower front edge of the rudder. In fixed inboard rudders, the lower end of the rudder is hinged to the skeg. The lower portion of the wedge member 32 that projects below the bottom of the hull in the present design forms the skeg in rudders of this design, but of course the lower end of the rudder 26 is not hinged to the skeg portion of the wedge member 32. It will be apparent, however, that the provision of a skeg portion on the wedge is not essential insofar as the invention is concerned. Thus, if desired, the wedge member 32 could be trapezoidal in shape with its bottom edge coinciding with the keel 20, thereby omitting the skeg portion which extends below the hull. Furthermore, the wedging action of the filler member may be omitted, in which case both the filler member and the space into which it fits within the rudder trunk are rectangular.

In still other arrangements embodying the invention, it may be desirable to place the rudder immediately in back of the daggerboard. In such case the trunk for the daggerboard must be wide enough for the rudder and post to be inserted through it when the daggerboard is removed and the after end of the well within the trunk must accommodate the rudder post as in the case where the separate trunk 18 is provided for the rudder. The daggerboard then becomes the filler member and holds the rudder post in place in the same way that the wedge member 32 holds the rudder in place in the trunk 18.

What is claimed is:

1. A removable inboard-rudder steering device for a boat comprising a trunk or housing mounted in the hull of the boat for providing access through the bottom of the boat, said trunk having a hollow space that is open at both the top and bottom, a rudder assembly comprising a rudder post and a rudder rigidly fixed to the lower end of said post;

said trunk space being large enough to allow said rudder to be lowered through it, said trunk having a seat portion opening inwardly of said trunk space such that said rudder post is displaceable laterally into and out of engagement therewith, a filler member corresponding in shape and size with said trunk space for substantially filling the entire trunk space on being inserted into the upper end thereof after said rudder is inserted through said trunk with said rudder post disposed adjacent said seat portion, said filler member having a bearing portion engageable with the side of said rudder post opposite said seat portion, such that when said filler member is located within said trunk said rudder post is held by said filler member against said seat portion for pivotal movement within said trunk, and means for locating said rudder post vertically with respect to said trunk.

2. A device as defined in claim 1, wherein said trunk is constructed so that the space within it is longitudinally narrower at the bottom than at the top and said filler member comprises a wedge of corresponding configuration, whereby said filler member urges said rudder post into engagement with said seat portion.

3. A device as defined in claim 2, wherein said rudder post is cylindrical and said seat portion comprises a semi-cylindrical surface corresponding to that of said rudder post and forming a bearing surface in said trunk for said rudder post, the adjacent side of said wedge having a matching semi-cylindrical surface for engagement with the opposite side of said rudder post and forming another bearing surface therefor.

4. A device as defined in claim 3, wherein said trunk is located on the centerline of the boat and said opening is elongated in the direction thereof, the width of said opening measured perpendicular to said centerline being not substantially greater than the width of said rudder and rudder post.

5. A device as defined in claim 4, wherein said means for positioning the rudder post vertically comprises a collar fixed to the upper end of said rudder post against movement longitudinally thereof, the lateral dimension of said collar being greater than the diameter of said bearing surfaces.

6. A device as defined in claim 5, which includes a horse-shoe shaped bushing permanently mounted in said trunk adjacent said seat portion and another horse-shoe shaped bushing permanently mounted adjacent an upper end of said wedge bearing surface against which the under side of said collar bears when said rudder assembly is properly positioned.

* * * * *